United States Patent [19]

Schueller

[11] Patent Number: 4,458,799

[45] Date of Patent: Jul. 10, 1984

[54] MARINE PROPULSION CONTROL SYSTEM INCLUDING MANEUVERING BRAKE

[75] Inventor: Niel Schueller, Germantown, Wis.

[73] Assignee: The Falk Corporation, Milwaukee, Wis.

[21] Appl. No.: 361,467

[22] Filed: Mar. 24, 1982

[51] Int. Cl.[3] ..... B60K 41/28

[52] U.S. Cl. ..... 192/0.072; 192/0.094; 192/3.57; 192/4 C; 440/74; 440/75

[58] Field of Search ..... 440/74, 75; 192/0.042, 192/0.044, 0.049, 0.055, 0.094, 0.098, 3.57, 4 C, 12 C, 17 A, 87.18, 87.19, 0.072

[56] References Cited

U.S. PATENT DOCUMENTS

| | | | |
|---|---|---|---|
| 3,543,891 | 12/1970 | Mathers | 192/0.094 |
| 3,669,234 | 6/1972 | Mathers | 192/0.098 |
| 3,900,090 | 8/1975 | Kobelt | 192/0.094 |
| 4,072,221 | 2/1978 | Phinney | 192/0.098 |
| 4,113,077 | 9/1978 | Phinney | 192/0.098 |
| 4,119,185 | 10/1978 | Phinney | 192/0.094 |

*Primary Examiner*—Sherman D. Basinger

*Attorney, Agent, or Firm*—Quarles & Brady

[57] ABSTRACT

An improved control system is disclosed for air actuated ahead and astern clutches, an engine speed governor, and a propeller shaft brake of a marine propulsion system. The control is actuated by a throttle lever which is moved from a neutral position to select a direction of travel. The degree of movement of the throttle lever from neutral is representative of the desired speed in the selected direction. The improved control engages the brake when the throttle lever is moved from an ahead to an astern direction at medium or high forward speeds. When such a change is commanded, a pair of serially connected brake valves are piloted to connect the brake to a source of air under pressure. One of the brake valves is piloted by an accumulated speed pressure signal indicating an ahead speed greater than a predetermined minimum and the other valve is piloted by the throttle signal commanding astern direction. The brake disengages either when the accumulated pressure signal exhausts to a level below that necessary to pilot the first brake valve or when the pressure within the astern clutch rises to a preselected level.

7 Claims, 2 Drawing Figures

MARINE PROPULSION CONTROL SYSTEM INCLUDING MANEUVERING BRAKE

BACKGROUND OF THE INVENTION

This invention relates to ship propulsion systems, and more particularly to a control for a propulsion system which includes a simplified control of a propeller shaft brake.

A common form of marine propulsion system uses ahead and astern air actuated clutches for connecting the prime mover to a reversing reduction gear unit which drives the propeller. The air actuated clutches are engaged by inflation and the degree of clutch engagement can be controlled by controlling the amount of inflation. A pneumatic control system is typically provided for selecting the ahead or astern clutches, for controlling the clutch inflation, and for controlling an engine speed governor which determines the engine speed. A single throttle lever apparatus can be provided for controlling both the clutch engagement and engine speed by movement of the lever from neutral towards either an ahead or astern direction. Examples of such a control for a ship's propulsion system are found in John M. Phinney U.S. Pat. No. 3,727,737, issued Apr. 17, 1973 for "Pressure Modulating System for Reversing Clutches and Throttle Control" and U.S. Pat. No. 4,072,221 issued Feb. 7, 1978 for "Marine Clutch and Throttle Governor Control System."

In the systems of these earlier patents, a pneumatic clutch control assembly for a ship's propulsion system is sequentially operated to regulate the inflation of ahead and astern air inflatable clutches and to also control the prime mover speed. The control assembly is actuated by a single throttle lever located on a pilot house control stand. Movement of the lever in one direction provides forward rotation of a propeller at a speed which increases with handle travel away from neutral. Movement of the handle in the opposite direction provides astern rotation of the propeller with speed increasing as the handle is moved farther from neutral. The center position provides a neutral setting in which the engine is disconnected from the propeller and no power is transmitted, although the engine continues to idle.

The single lever control of both direction and speed is accomplished in the following manner: As the lever is pivoted in either direction from neutral, air is supplied to a selector valve which selects one or the other of the ahead or astern clutches. Thereafter, and up to a first control pressure, air pressure proportional to the position of the lever away from neutral is fed through a first valve to the selected clutch and begins inflating the selected clutch. During this time the engine remains at idle speed. After a first control pressure is reached, the first valve is piloted and a second path for air to the clutch is established. This second path has provision for an initial programmed rate of feed of air to the clutch through a choke valve so as to softly inflate the clutch. Upon reaching a second higher control pressure, full supply air pressure is connected to the clutch. After the first control pressure is reached, the continued inflation of the clutch is not dependent upon the position of the throttle lever.

When the air pressure within the clutch rises to a predetermined level, the control of these earlier patents pilots a governor valve which, in effect, connects the throttle lever control to the speed governor of the engine so that the pressure supplied to the governor directly corresponds to the position of the throttle lever and the engine speed is controlled by movement of the throttle lever. The throttle lever setting determines only the final operating speed and direction. All intermediate steps of clutch engagement and inflation, as well as engine governor speed, are handled automatically by the control system.

Certain conditions of operation of ship propulsion systems require sudden reversals of direction. A typical situation in which sudden reversal is required is the so-called "crash reversal" in which the ship's pilot commands a sudden reversal of the direction of rotation of the propeller from a medium or high forward speed to reverse direction in order to prevent a collision. In such situations, the clutches are subjected to considerable load because of the need to first halt the rotation of the propeller shaft in one direction before it can be started to rotate in the opposite direction. This can result in the build-up of considerable heat in the clutches which, if severe enough, can lead to failure of the clutches. To protect the clutches in such situations, it has been typical to apply a brake to the propeller shaft when a shift is commanded from high speed travel in one direction to the opposite direction. The purpose of the brake is to absorb heat and relieve the clutches of a portion of the heat load which would otherwise be imposed upon them during high speed maneuvers.

When propeller shaft brakes have been used in the past, the control systems have functioned to apply the brake during a delay period in neutral when neither the ahead nor astern clutches are engaged. Past systems have also typically applied the brake without regard to whether the reversal in direction was from ahead to astern or astern to ahead. Examples of such systems are found in to Harold M. Mathers U.S. Pat. No. 3,543,891 issued Dec. 1, 1970 for "Controls for Engine, Brake and Forward/Reverse Clutches" and U.S. Pat. No. 3,669,234 issued June 30, 1972 for "Fluid Controls for Engine and Forward/Reverse Transmission." Another example of such a system is found in U.S. Pat. No. 3,900,090 issued Aug. 19, 1975 to Jack R. Kobelt for "Engine Remote Control." A disadvantage to the use of a delay period during which the brake is engaged is that it lengthens the time required to alter the ship's direction and it creates a period during which the ship is not under full control. Further, astern direction travel is most often carried out at a low speed so that shifting from astern to ahead rarely overloads the clutches, and the time delay in engagement of ahead direction clutches is unnecessary when a reversal from astern to ahead is commanded.

Another approach involving the use of a maneuvering brake is found in U.S. Pat. No. 4,119,185 issued Oct. 10, 1979 to John M. Phinney for "Marine Propulsion Control System with Maneuvering Brake." That system operates only when a reversal from medium or high speed ahead operation is commanded. However, it too introduces a delay in the inflation of the astern clutch, which delay is dependent upon the forward speed.

I have provided a simplified control for a maneuvering brake which is effective in its operation but does not require a delay in the engagement of the astern clutch when reversal from medium or high forward speed is commanded.

SUMMARY OF THE INVENTION

In accordance with my invention, I provide a marine propulsion system having a prime mover controlled by a throttle speed governor, a drive train for transmitting power from the prime mover to a propeller drive shaft, ahead or astern air inflatable clutches for selectively connecting the prime mover to the drive train, a brake operable on the propeller drive shaft, throttle means for actuation of the propulsion system and including means for producing alternative ahead and astern direction pressure signals indicative of the desired direction of travel and a speed signal whose magnitude is proportional to desired speed, and means for controlling the inflation of the selected clutch, such control including means accumulating a pressure signal responsive to the speed signal while the ahead clutch is inflated, such accumulating means discharging the pressure signal at a controlled rate after the ahead clutch has been deflated; and a pair of brake control valves connected in series between the brake and a source of air under pressure, a first of said valves completing the connection only so long as the accumulated pressure signal is above a predetermined level and the second of such valves completing the connection whenever the throttle means produces an astern direction pressure signal and so long as the pressure within the astern clutch is below a preselected level.

Further in accordance with the invention, I provide such a control in which the second valve is piloted to a position completing the connection by the output of an adjustable regulating valve and such piloting pressure is opposed by the combination of a bias force and the pressure in the astern clutch.

It is a principal object of the invention to provide a single control for engaging a brake on the propeller shaft to assist in reversal of the propeller from medium or high ahead vessel speeds.

It is a further object of the invention to provide such a control in which there is no time delay to the inflation of the astern clutch while the brake is engaged.

The foregoing and other objects and advantages of this invention will appear in the following detailed description. In the description reference is made to the accompanying drawings which illustrate a preferred embodiment of the invention.

DETAILED DESCRIPTION OF THE PREFERRED EMBODIMENT

Figure 1:
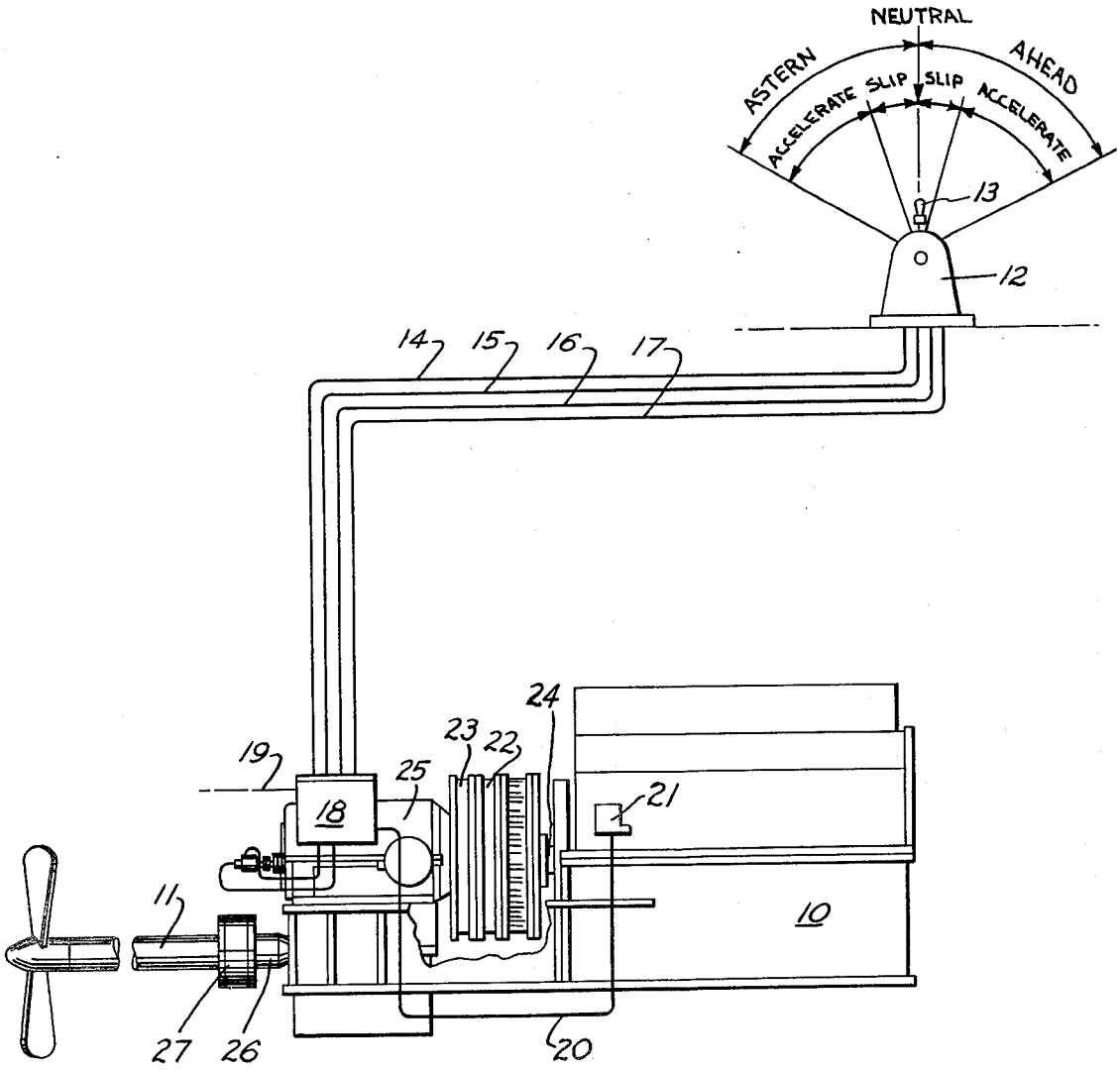
FIG. 1 is a schematic representation of a ship's propulsion control system with which the improved control system of the present invention may be employed.

FIG. 1 illustrates a known arrangement of a pneumatically controlled marine propulsion system which controls the speed of the ship's engine 10 and its connection to the propeller shaft 11. The propulsion system includes a pilot house control stand 12 which mounts a throttle lever 13 controlling a throttle valve which connects four air lines 14, 15, 16 and 17 to a control panel assembly 18.

The control panel assembly 18 is connected to the ship's pressurized air source by a main supply line 19. The panel assembly 18 under control of the throttle lever 13 functions to regulate the supply of air through a line 20 to a throttle speed governor 21 for the engine 10 and also functions to control the supply of air to an ahead clutch 22 and an astern clutch 23. The clutches 22 and 23 act to transmit torque from the engine 10, through a drive shaft 24, to the input of a reverse reduction gear train 25 whose output shaft 26 is connected to the propeller shaft 11. The engine 10 is unidirectional and its output is high in speed but low in torque. The reverse reduction gear train 25 functions to reduce the rotational speed and to increase the torque, and also to reverse the direction of drive when required.

In accordance with the present invention, a brake 27 is operative on the output shaft 26 connected to the propeller shaft 11.

The throttle lever 13 is movable forwardly or rearwardly from a neutral position as indicated in FIG. 1 to select the ship's direction of travel. The amount of movement of the throttle lever 13 from neutral regulates the degree of clutch engagement and thereafter the engine speed.

Figure 2:
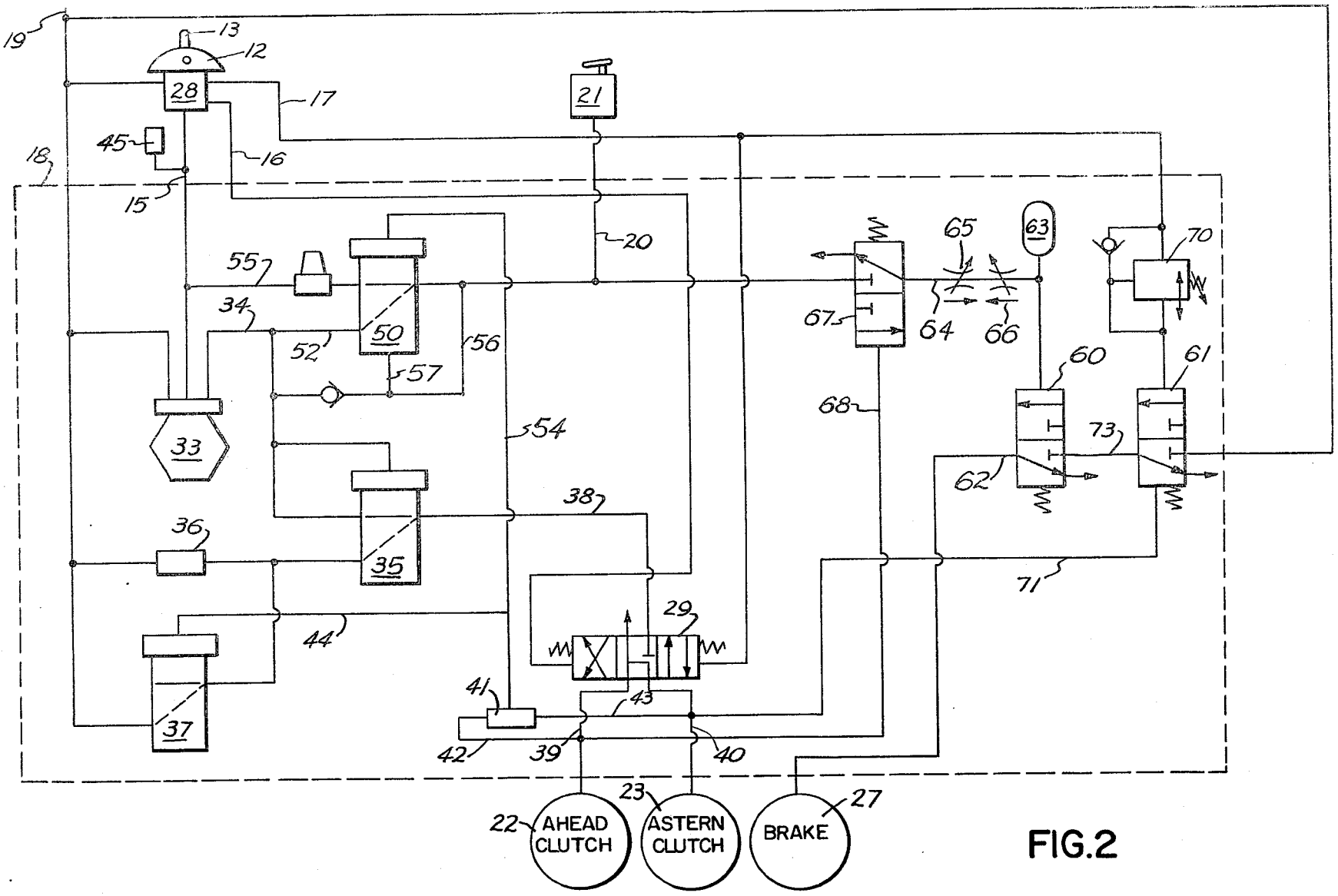
FIG. 2 is a schematic representation of the control system incorporating the present invention and connected to operate the propulsion system of FIG. 1.

Referring to FIG. 2, the throttle lever 13 directly controls a pressure control and directional flow control throttle valve 28. The throttle valve 28 is of known construction and is operative to furnish full supply air pressure from the supply line 14 which leads from the supply air line 19 to one or the other of the ahead or astern piloting air lines 16 and 17, respectively. The throttle valve 28 also supplies graduated pressure to the air line 15 and the graduated pressure is always proportional to the degree of movement of the lever 13 away from neutral.

If the lever 13 is pivoted at least five degrees forward or backward from its neutral position, the throttle valve 28 will connect the supply line 14 to the appropriate piloting air line 16 or 17. If the ahead piloting line 16 is selected, it operates directly to actuate a four-way selector valve 29 for selection of the ahead clutch 22. If the astern piloting line 17 is selected, it operates directly upon the clutch selector valve 29 for selection of the astern clutch 23. The movement to select the desired clutch for the desired direction of movement is not sufficient to cause full engagement of the clutches selected, even if the clutch selector valve 29 is immediately actuated. Instead, the initial movement from the neutral position places the propulsion system in a slip condition in which there is insufficient air in the selected clutch to prevent clutch slippage even when the ship's engine 10 is operating at idle throttle speed.

The speed signal line 15, whose air pressure is proportional to lever position, leads to the pilot port of a relay valve 33 whose inlet port is connected to the supply air line 19 and whose outlet port is connected by a line 34 to the inlet port of a master control valve 35. The relay valve 33 will relay or repeat large quantities of supply air from the supply line 19 to the line 34 at a pressure level which is the same as the air pressure in the speed signal line 15. The relay valve 33 and its connection to the supply air line 19 and master control valve 35 constitute a first air branch.

The master control valve 35 has a second inlet port which is connected to a second air branch leading from the air supply line 19. The second branch includes a choke valve 36 and a boost valve 37 connected in parallel across the supply air line 19 and the second inlet port of the master control valve 35.

An outlet port of the master control valve 35 connects to a third air branch which comprises an operating line 38 connected to the inlet port of the clutch selector valve 29. The clutch selector valve 29 has a pair of outlet ports connected by the operating lines 39 and 40 to the ahead clutch 22 and astern clutch 23, respectively.

After the throttle lever 13 has been moved about five degrees forwardly or rearwardly of its neutral position, air under pressure will pass through the master control valve 35 and the clutch selector valve 29 to begin to inflate the selected clutch 22 or 23. During the inflation of one of the clutches, the other clutch will be deflated through its corresponding exhaust port in the clutch selector valve 29. When the control lever 13 is in its neutral position, both clutches 22 and 23 are exhausted to the atmosphere through their respective exhaust ports.

The master control valve 35 is a pneumatic-piloted, pressure sensitive valve that changes the air passages within itself when air at a first control pressure, or higher, is supplied to its pilot port. The pilot port is coupled to the operating line 34 which is also connected to the first inlet port of the master control valve 35. Thus, air at the same pressure level is supplied to both the first inlet port and the pilot port of the master control valve 35 and this pressure is at the same level as that supplied to the relay valve 33 by the line 15 and is representative of the position of the throttle lever 13. So long as the pressure supply through the operating line 34 is less than a first control pressure, which is the piloting pressure for the master control valve, that pressure supply will be directed through the master control valve 35 to the operating line 38 and thence to the selected clutch 22 or 23.

When the throttle lever 13 is moved to a position from neutral such that the first control pressure for the master control valve 35 is exceeded, the master control valve 35 will disconnect the first air branch from the clutches and will instead connect the second air branch to the clutch being controlled. At first the choke valve 36 will function to permit air to flow from the supply air line 19 through the master control valve 35 and to the operating line 38 at a programmed rate that is determined by the size of the choke valve 36. As a result, the clutch is not abruptly fully inflated. There is no flow of air through the boost valve 37 at this time because the boost valve 37 is normally closed and will not open until piloted by the air pressure within the clutch being inflated.

The piloting of the boost valve 37 is provided by a clutch inflation shuttle valve 41 which has a pair of inlet ports connected by lines 42 and 43 to the operating lines 39 and 40 for the ahead and astern clutches 22 and 23, respectively. The outlet of the clutch inflation shuttle valve 41 is connected by a piloting line 44 to the pilot port of the boost valve 37. The shuttle valve 41 will connect either one, but not both, of its inlets with its outlet. Thus, air is siphoned from the particular clutch 22 or 23 which is at the highest pressure and is supplied to the pilot port of the boost valve 37. When the air pressure within the inflating clutch reaches a second control pressure at which the boost valve 37 is set to be piloted, that valve will open to connect the supply air line 19 to the second inlet port of the master control valve 35 thereby bypassing the choke valve 36. When this occurs, full supply air pressure is supplied to the operating line 38 and the clutch selector valve 29 so that the selected clutch 22 or 23 will be fully inflated. To deflate, the throttle lever 13 is returned to its neutral position which will cause the clutch selector valve 29 to connect the exhaust ports to the clutches 22 and 23. A bleeder valve 45 is installed to eliminate hysteresis between supply and exhaust portions of the throttle valve 28 under low pressure conditions.

The control panel assembly 18 controls the throttle speed governor 21 by means of a double-piloted throttle governor valve 50. The throttle governor valve 50 has an inlet connected by a line 52 to the operating line 34 leading from the outlet of the relay valve 33. An outlet port of the throttle governor valve 50 is connected by a speed signal line 53 to the operating line 20 for the throttle speed governor 21. The governor valve 50 has a first pilot port connected by a pilot line 54 to the outlet of the clutch inflation shuttle valve 41. The governor valve 50 is provided with an air pressure signal indicative of the speed at which the engine is to run following engagement of the selected clutch.

The purpose and operation of the governor valve 50 is fully described in U.S. Pat. No. 4,072,221. Briefly stated, the throttle governor valve 50 controls the speed signal which is imposed upon the throttle speed governor 21 through the line 20 and it will prevent the speed signal from being transmitted at a level which exceeds the clutch capacity under situations where supply air pressure is lost or diminished for any reason such as dirt or contaminations in the line, or a leak.

If the piloting pressure in the line 54 leading from the clutch inflation shuttle valve 41 is sufficient to initially overcome the force of a biasing spring within the governor valve 50, an exhaust valve within the governor valve 50 will first be closed and thereafter the inlet connected to the line 52 will be opened to the outlet leading to the line 53. The throttle governor valve 50 will then be opened and an air pressure signal proportional to the position of the throttle lever 13 will pass from the inlet to the outlet and thence to the engine speed governor 21. In this manner engine speed will be controlled by varying the throttle lever position to vary the air pressure signal.

Once the governor valve 50 has been opened, a counter biasing piloting pressure is exerted on the valve which is added to the force of the internal spring which must be overcome by the piloting pressure. This reverse bias pressure is equal to the air pressure which is being transmitted through the governor valve 50 to the throttle speed governor 21 and is directed on a second piloting port through lines 56 and 57 which lead from the outlet line 53 of the governor valve 50. Thus, once the governor valve 50 has opened, the actual air pressure within the selected clutch as transmitted through the clutch inflation shuttle valve 41 must exceed the governor signal pressure plus the force of the governor valve spring. If the supply air pressure is lost or diminished, the maximum governor signal which is allowed to be transmitted to the operating line 20 will be reduced in proportion to the falling clutch pressure.

The operation and control described thus far does not differ from known controls. The system in accordance with the present invention controls the operation of a maneuvering brake 27 to assist in reversal of the propeller from medium to high ahead vessel speeds.

The brake 27 is also pneumatically actuated, similar to the clutches 22 and 23. The brake 27 is connectable to the supply line 19 through first and second brake valves 60 and 61, respectively. Both of the brake valves 60 and 61 are two-position, two-way valves which are spring biased to a normal position in which a brake line 62 is connected to exhaust. Both of the brake valves 60 and 61 are piloted to positions in which they will complete the connection between the supply line 19 and the brake line 62. The first brake valve 60 is piloted by an accumulated speed signal pressure while the second brake valve 61 is piloted by the pressure appearing in the astern selector line 17.

Specifically, an accumulator 63 is connected through a line 64 containing a pair of adjustable inflowing and outflowing orifices 65 and 66, respectively, to one side of a two-position, two-way shift valve 67. The other side of the shift valve 67 is connected to the line 53 which is imposed with the speed signal for the speed governor 21. The shift valve 67 is spring biased to a position in which the line 64 containing the two orifices 65 and 66 is exhausted to the atmosphere. The shift valve 67 is piloted to its alternate position in which it connects the speed signal line 53 to the accumulator 63. Piloting of the shift valve 67 is accomplished through a line 68 which leads from the ahead clutch inflation line 39. Thus, the shift valve 67 will be shifted to a position in which the speed signal pressure in the line 53 is imposed upon the accumulator 63 only after the ahead clutch 22 has been selected and is inflated to a pressure greater than the spring bias force on the shift valve 67.

The pilot port of the second brake valve 61 opposing the spring bias of that valve is connected to the output of an adjustable regulating valve 70. The input to the regulating valve 70 is connected to the astern selector line 17. The regulating valve 70 is adjustable so that it will output a pressure which is equal to its setting regardless of the level of the input pressure, so long as the input pressure is at least as great as the setting of the valve 70. The second brake valve 61 is also subjected to a second piloting pressure through a pilot line 71 which is connected to the astern clutch inflation line 40. This second piloting pressure is additive of the spring bias force in the second brake valve 61 and opposes the output of the regulating valve 70.

The operation of the maneuvering brake control will be explained in relation to a typical circuit in which the supply air pressure is 140 psi. In such a system, the spring bias force on the shift valve 67 and on the second brake valve may be 70 psi, and the spring bias force on the first brake valve 60 may be 45 psi. The regulating valve 70 would typically be adjusted to a pressure setting in the range of 80 to 90 psi. The maneuvering brake 27 will only be actuated under conditions in which the propeller has been driven in an ahead direction and at a vessel speed which is sufficient to pressurize the accumulator 63 to a pressure of at least 45 psi so that the pressure within the accumulator 63 is sufficient to overcome the spring force in the first brake valve 60 to thereby shift the valve. The ahead direction of motion of the propeller must have been present so that the shift valve 67 has been piloted to a position where the speed signal in the line 53 is imposed upon the accumulator 63. In the typical system being described, a 45 psi speed signal would be about one-third full speed. If the propeller is being driven in the ahead direction and is being operated at medium or high speed, the first brake valve 60 will be piloted by the accumulator 63 and the control system will be placed in a condition in which the maneuvering brake can be engaged. However, the brake 27 will not be engaged until a reversal of propeller direction is commanded. Specifically, upon the selection of the astern clutch by pressurizing the line 17, the regulating valve 70 will pass a pressure sufficient to pilot the second brake valve 61 thereby connecting the brake 27 to the supply line 19. The brake 27 will be actuated and will accomplish the braking of the propeller shaft from its prior ahead direction of rotation so that it can begin its reversal. Selection of the astern clutch will also result in venting of the ahead clutch 22. When the pressure within the ahead clutch 22 drops to less than 70 psi, the shift valve 67 will be returned to its normal position and the accumulator 63 will be exhausted slowly through the adjustable orifice 65.

The maneuvering brake 27 will remain engaged until either one of the following two conditions occurs: the pressure in the accumulator drops below 45 psi which is a function of the time of exhaustion through the adjustable orifice, or the astern clutch is inflated to a pressure which when added to the spring bias force of the second brake valve 61 is sufficient to overcome the pressure setting of the regulating valve 70. The first condition shifts the first brake valve 60 and the second condition shifts the second brake valve 61. In either event, the brake 27 is disconnected from the supply line 19.

The time required to exhaust the accumulator 63 to below 45 psi will depend upon the pressure at the time that reversal of direction is commanded and that pressure is dependent upon the forward speed signal. The faster that the propeller was turning in an ahead direction at the time of reversal, the longer the brake 27 can or must be applied to slow the propeller. The time required to exhaust the accumulator 63 can be adjusted for a given pressure by adjusting the outflowing orifice 65.

The astern clutch 23 will begin to inflate immediately upon a reverse direction being commanded. At the same time, the brake 27 will be engaged if the forward speed has been high enough. The astern clutch 23 will take over the control of the propeller shaft from the brake 27 after it has inflated to a preselected level which can be adjusted to insure that the astern clutch 23 will not be harmed. The adjustment is accomplished by adjusting the regulating valve 70.

The use of the adjustable regulating valve 70 permits the fine tuning of the timing of the release of the brake in the reversal cycle and allows adjustment of the control to the precise characteristics of the vessel upon which it is installed.

I claim:

1. In a pneumatic clutch control system for a marine propulsion system having a prime mover controlled by a throttle speed governor, a drive train for transmitting power from the prime mover to a propeller drive shaft, ahead and astern air inflatable clutches for selectively connecting the prime mover to the drive train, an air actuated brake operable on the propeller drive shaft, throttle means for actuation of the propulsion system and including means for producing alternative ahead and astern direction pressure signals indicative of the desired direction of travel and a speed signal whose magnitude is proportional to desired speed, and means for controlling the inflation of the selected clutch from a source of air under pressure, the combination therewith of:

means accumulating a pressure signal responsive to said speed signal while said ahead clutch is inflated for ahead direction of travel, said accumulating means discharging said pressure signal at a controlled rate after the ahead clutch has been deflated;

a pair of brake control valves connected in series with each other and connected directly between the brake and the air source, a first of said valves completing the connection only so long as the accumulated pressure signal is above a predetermined level and the second of such valves completing the connection whenever the throttle means produces an astern direction pressure signal and so long as the pressure within the astern clutch is below a preselected level.

2. A control system in accordance with claim 1 wherein said second brake control valve is biased to a position which exhausts the connection between the brake and the air source and which is piloted by the astern direction pressure signal to a position completing such connection.

3. A control system in accordance with claim 2 wherein the second brake control valve is connected to be piloted by the pressure within the astern clutch and such piloting pressure is additive of the biasing force, and the astern direction pressure signal is transmitted through an adjustable regulating valve to provide a piloting force on the second brake valve which opposes the biasing force and the piloting pressure from the astern clutch.

4. In a pneumatic clutch control system for a marine propulsion system having a prime mover controlled by a throttle speed governor, a drive train for transmitting power from the prime mover to a propeller drive shaft, ahead and astern air inflatable clutches for selectively connecting the prime mover to the drive train, an air actuated brake operable on the propeller drive shaft, throttle means for actuation of the propulsion system and including means for producing alternative ahead and astern direction pressure signals indicative of the desired direction of travel and a speed signal whose magnitude is proportional to desired speed, and means for controlling the inflation of the selected clutch from a source of air under pressure, the combination therewith of:

means accumulating a pressure signal responsive to said speed signal while said ahead clutch is inflated for ahead direction of travel, said accumulating means discharging said pressure signal at a controlled rate after the ahead clutch has been deflated;

a pair of two-position, two-way brake control valves connected in series directly between the brake and the air source, said brake control valves being both biased to a position which exhausts the connection between the brake and the air source, a first of said brake control valves being piloted by said accumulated pressure signal to a position completing the connection for so long as the accumulated pressure signal is above a predetermined level, and the second of said brake control valves completing the connection whenever the throttle means produces an astern direction pressure signal and so long as the pressure within the astern clutch is below a preselected level; and an adjustable regulating valve connected to receive said astern direction pressure signal and to pass a piloting force to said second brake control valve which opposes the combination of the biasing force and the pressure with the astern clutch.

5. A control system in accordance with claim 4 wherein said accumulating means is connected to receive said speed signal through a shift valve which is biased to connect the accumulating means to exhaust and which is piloted to complete the connection to the speed signal by the pressure within the ahead clutch.

6. A control system in accordance with claim 5 wherein said accumulating means discharges to exhaust through an adjustable orifice.

7. A control system in accordance with claim 4 wherein the biasing force acting on said first brake valve establishes said predetermined pressure level, and the setting of said adjustable regulating valve less the biasing force acting on said second brake valve establishes said preselected pressure level.

* * * * *